US007249580B2

(12) United States Patent
Martinez

(10) Patent No.: US 7,249,580 B2
(45) Date of Patent: Jul. 31, 2007

(54) VALVE RETURN DEVICE, AND AN ENGINE EQUIPPED WITH SUCH A DEVICE

(75) Inventor: Patrice Martinez, Le Perray En Yvelines (FR)

(73) Assignee: Intertechnique (FR)

( * ) Notice: Subject to any disclaimer, the term of this patent is extended or adjusted under 35 U.S.C. 154(b) by 193 days.

(21) Appl. No.: 11/081,188

(22) Filed: Mar. 16, 2005

(65) Prior Publication Data

US 2005/0217619 A1 Oct. 6, 2005

(30) Foreign Application Priority Data

Mar. 17, 2004 (FR) ..... 04 02764

(51) Int. Cl.
*F01L 1/02* (2006.01)

(52) U.S. Cl. ..... 123/90.14; 123/90.12

(58) Field of Classification Search ..... 123/90.12, 123/90.13, 90.14

See application file for complete search history.

(56) References Cited

U.S. PATENT DOCUMENTS 5,233,950 A 8/1993 Umemoto et al.

6,738,706 B2 * 5/2004 Cullen et al. ..... 701/103

FOREIGN PATENT DOCUMENTS

FR 2 529 616 1/1984

* cited by examiner

*Primary Examiner*—Ching Chang
(74) *Attorney, Agent, or Firm*—Dean W. Russell; Kilpatrick Stockton LLP

(57) ABSTRACT

The invention relates to a return device for returning a valve of an internal combustion engine, the device comprising:

a piston secured to said valve and mounted to slide in a cylinder;

a pressurized fluid feed connected to said cylinder via a feed channel; and a pressure relief valve connected to said cylinder via a discharge channel and arranged to limit the pressure prevailing in the cylinder to a predetermined maximum pressure; and means for regulating the maximum pressure as a function of the feed pressure using an affine-type relationship.

The invention also relates to an internal combustion engine equipped with such a device.

10 Claims, 8 Drawing Sheets

VALVE RETURN DEVICE, AND AN ENGINE EQUIPPED WITH SUCH A DEVICE

CROSS-REFERENCE TO RELATED APPLICATION

This application claims priority to French Patent Application No. 0402764 filed on Mar. 17, 2004, the contents of which are incorporated by reference herein.

The invention relates to controlling valves in internal combustion engines.

It relates to a return device for returning a valve, and to an internal combustion engine equipped with such a device.

BACKGROUND OF THE INVENTION

It is recalled that admission and exhaust valves in internal combustion engines are opened and closed by a camshaft constrained to rotate with the drive shaft.

In order to open and close a valve at the chosen instant, it is essential for said valve to be held in contact with the corresponding cam on the camshaft.

That is why engines are equipped with return devices for each valve, each return device comprising a spring that urges said valve continuously towards its closed position (i.e. towards the corresponding cam).

Most of such return devices comprise mechanical springs which, when the engine speed is moderate, hold the valve continuously in abutment against the corresponding cam.

However, the main drawback of mechanical springs is that they start to resonate when engine speed becomes sufficiently high. That "valve hunting" phenomenon results in the movement in translation of the valve being dissociated from the movement in rotation of the camshaft.

As a result, considerable loss of power occurs.

Various solutions have been proposed for remedying that problem.

Thus, it is known that each valve can be equipped with a plurality of return springs of differing rates, in order to raise the resonant frequency of the resulting resilient system.

That solution is suitable for mass-produced engines whose operating speeds are quite moderate (i.e. their maximum speed generally does not exceed 8000 revolutions per minute (r.p.m.)).

However, that solution is too limited for motorbike and racing car engines whose maximum speeds are often in excess of 15,000 r.p.m.

Indeed, appearance of the valve hunting phenomenon has already been observed in that type of engine, even when the valves are equipped with multiple return spring devices.

In order to remedy that problem, in certain high-speed engines, it has been proposed to replace the mechanical springs with pneumatic springs, which are less likely to start resonating at high engine speeds.

Thus, a pneumatic return device for returning valves for internal combustion engines is known from Document FR-2 529 616, published some time ago.

That system includes a piston secured to a valve stem and slidably received in a cylinder forming a leaktight chamber that encloses a compressible fluid which is at a predetermined rated minimum pressure corresponding to the fully closed position of the valve.

Although that system has already given satisfaction, it does not make it possible to control the return force to which the valve is subjected.

Document U.S. Pat. No. 5,233,950 makes provision to equip the return device with means for regulating the pneumatic pressure prevailing in the cylinder in which the valve is slidably received.

Although the valve control system proposed in that document constitutes an improvement on the system of document FR-2 529 616, the implementation structure for pressure regulation is nevertheless relatively complex, and its insufficient reactivity proves to be detrimental when engine speed varies suddenly.

OBJECTS AND SUMMARY OF THE INVENTION

A particular object of the invention is to remedy the above-mentioned drawbacks by proposing a return device that makes it possible to regulate accurately the return force to which the valve is subjected and that, while presenting increased reactivity (i.e. a reduced response time, in particular when engine speed varies suddenly), makes it possible to reduce further the risk of valve hunting.

To this end, the invention provides a return device for returning a valve of an internal combustion engine, the device comprising:

- a piston secured to said valve and mounted to slide in a cylinder;
- a pressurized fluid feed connected to said cylinder via a feed channel; and
- a pressure relief valve connected to said cylinder via a discharge channel and arranged to limit the pressure prevailing in the cylinder to a predetermined maximum pressure;

said device further comprising means for regulating the maximum pressure as a function of the feed pressure using an affine-type relationship.

It is thus possible to cause the rate of the pneumatic spring constituted by the pressurized fluid contained in the cylinder to vary linearly as a function of predetermined parameters, such as engine speed.

As a result, the regulation of the return force to which the valve is subjected is improved, thereby reducing the risk of valve hunting.

For example, the maximum pressure is a function of the feed pressure using a relationship of the following type:

$$P_M=\lambda P_A+P_2$$

where:

$P_M$ is the maximum pressure;

$\lambda$ is a constant;

$P_A$ is the feed pressure; and $P_2$ is a constant

In a preferred embodiment, the pressure relief valve is provided with a return spring, in which case the constant $P_2$ is the rated pressure of said pressure relief valve, delivered by said return spring.

In order to satisfy the above-presented pressure relationship, the pressure relief valve is, for example, connected to the feed via a branch channel.

In addition, a check valve may also be provided, placed on the feed channel, with the branch channel being connected to the feed upstream from the check valve.

The feed may be controlled so as to regulate the feed pressure as a function of one or more determined parameters, such as engine speed.

Thus, the feed is preferably controlled so as to increase the feed pressure when the engine speed increases.

The invention also provides an internal combustion engine equipped with a return device as presented above.

BRIEF DESCRIPTION OF THE DRAWINGS

Other objects and advantages of the invention appear from the following description given with reference to the accompanying drawings, in which.

MORE DETAILED DESCRIPTION

Figure 1:
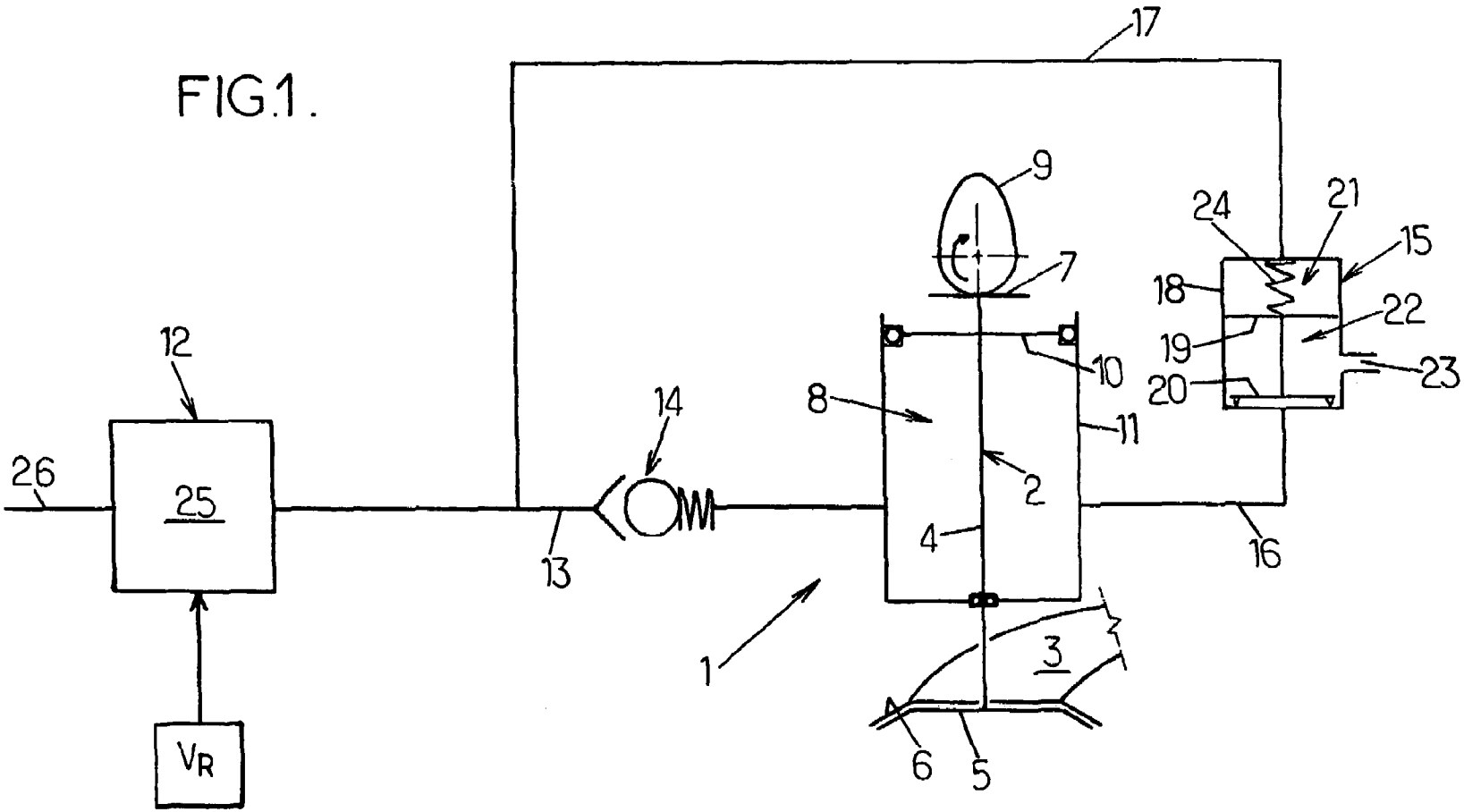
FIGS. 1 to 6 are diagrammatic views of the return device for returning a valve, successively showing a full opening/closure cycle of the valve.
Figure 2:
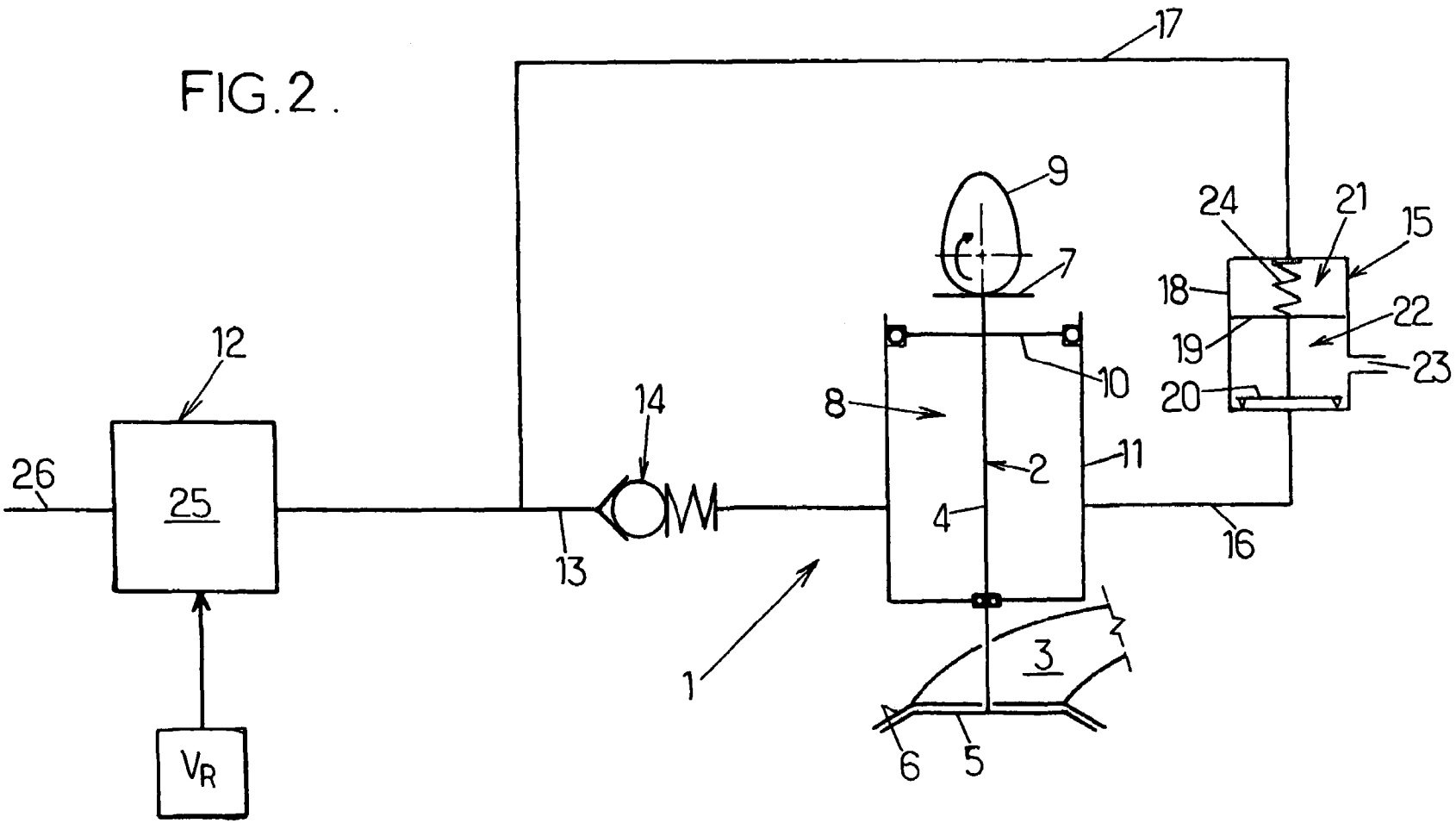
Figure 3:
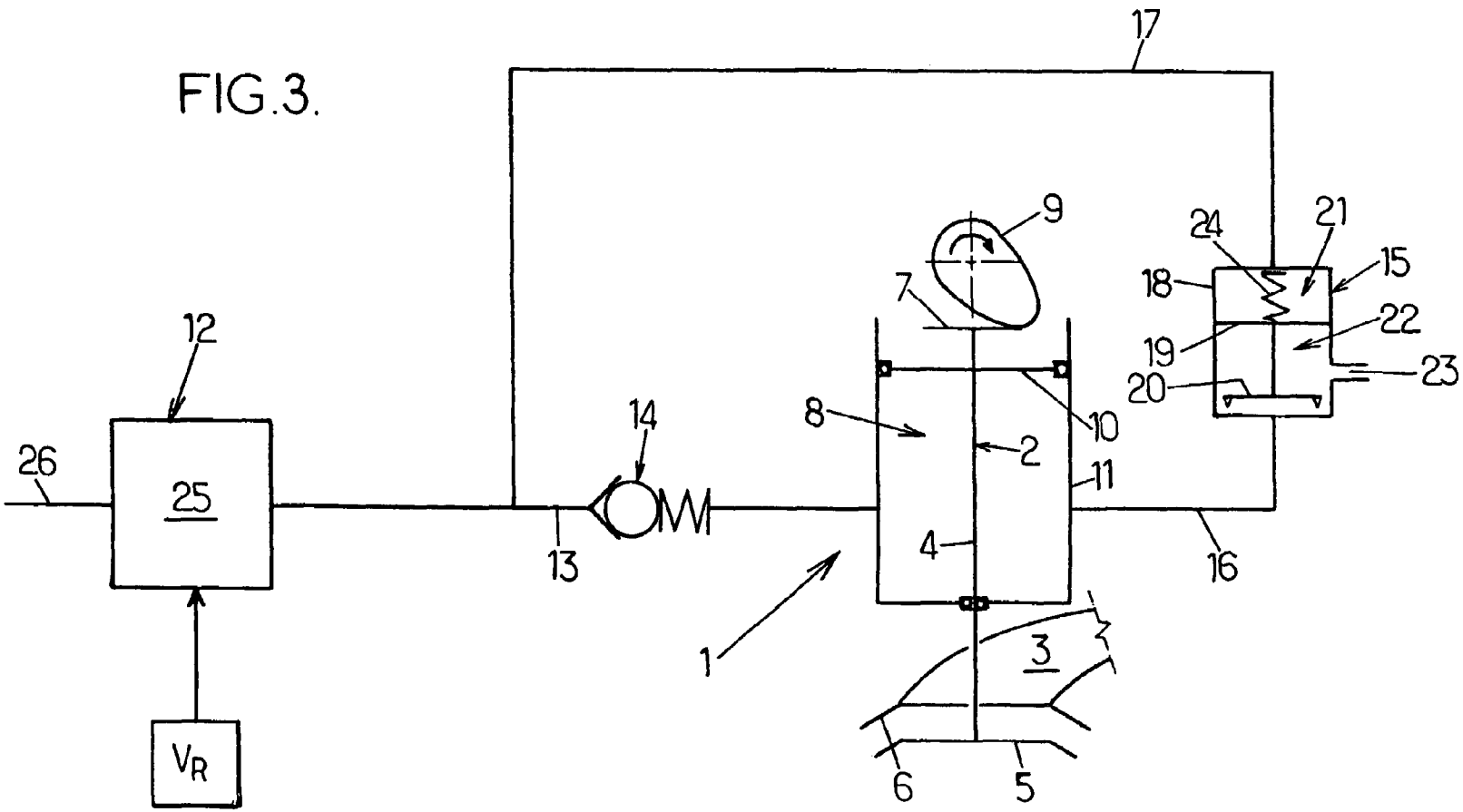

FIG. 1 shows a return device 1 for returning a valve 2 of an internal combustion engine of which only the admission (or exhaust) port 3 that the valve opens and closes is shown.

As can be seen in FIG. 1, the valve 2 has a stem 4 that is terminated at one of its ends by a head 5 suitable for coming into abutment against a seat 6 that forms the mouth of the admission port 3.

At its opposite end, the stem 4 is terminated by a tail 7 shaped to form a cam follower that is held in abutment by a pneumatic spring 8 (described below) against a cam 9 of a camshaft that, by rotating, causes the valve 2 to open and to close.

The valve 2 is provided with a piston 10 which is secured to the valve stem 4 and is mounted to slide in a cylinder 11.

The device 1 also includes a pressurized fluid feed 12 in fluid connection with the cylinder 11 via a feed channel 13 on which a check valve 14 is placed.

The device 1 further includes a pressure-relief valve 15 in fluid connection firstly with the cylinder 11 via a discharge channel 16 and secondly with the feed 12 via a branch channel 17 which, as can be seen in FIGS. 1 to 6, is connected to the feed 12 upstream from the check valve 14.

The pressure relief valve 15 includes a cylinder 18 which slidably receives a piston 19 to which a valve member 20 is secured. The piston 19 subdivides the cylinder 18 into two chambers isolated from each other in leaktight manner, namely an excess-pressure chamber 21 into which the branch channel 17 opens out, and an expansion chamber 22 into which the discharge channel 16 opens out and into which a venting channel 23 opens out that guarantees that the pressure prevailing inside the expansion chamber 22 is constantly equal to atmospheric pressure.

The piston 19 is mounted to move between a "closed" position (shown in FIG. 1) in which the valve member 20 closes off the discharge channel 16, and an "open" position (shown in FIG. 3) in which the valve member 20 is spaced apart from the discharge channel 16 that it thereby puts into communication with the expansion chamber 22.

The surface area of that surface of the piston 19 which faces towards the excess-pressure chamber 21 is referenced $S_P$, and the surface area of that surface of the valve member 20 which faces towards the discharge channel 16 is referenced $S_S$.

As can be seen in FIGS. 1 to 6, the pressure relief valve 15 is equipped with a return spring 24 which continuously urges the piston 19 towards its closure position.

In an embodiment shown in FIGS. 1 to 6, the feed 12 includes a pressure regulator connected via a channel 26 to a pressurized fluid source (not shown), said regulator being arranged to cause the pressure in the feed channel 13 to vary as a function of one or more determined parameters, such as engine speed which is characterized by the speed of revolution (referenced $V_R$) of the drive shaft.

The following notation is used:

$P_A$ designates the feed pressure that prevails in the feed channel 13 upstream from the check valve 14 and in the branch channel 17;

$P_1$ designates the rated pressure of the check valve 14;

$P_2$ designates the rated pressure of the pressure relief valve 15 that results form the return force exerted on the piston by the spring 24;

P designates the pressure prevailing in the cylinder 11, in the feed channel 13 downstream from the check valve 14, and in the discharge channel 16;

$P_m$ designates the minimum value for the pressure P, said minimum value making the following relationship true:

$$P_A = P_m + P_1$$

Where λ is the (constant) ratio between the surface areas $S_P$ and $S_S$:

$$\lambda = \frac{S_P}{S_S}$$

$P_M$ designates the maximum value for the pressure P; this value corresponds to the pressure prevailing in the excess pressure chamber 21, and therefore makes the following relationship true:

$$P_M = \lambda P_A + P_2$$

and $P_0$ designates atmospheric pressure.

The pressure relief valve 15 is arranged to limit the pressure P prevailing in the cylinder 11 to the maximum pressure $P_M$: when the pressure P reaches or exceeds said maximum pressure $P_M$, the fluid in the discharge channel 16, coming from the cylinder 11, exerts on the valve member 20 a pressure that compensates for the pressure $P_M$ prevailing in the excess pressure chamber 21, thereby tending to displace the piston 19 (initially in its closed position) towards it open position, thereby putting the discharge channel 16 into communication with the expansion chamber 22.

Operation of the device 1 is described below.

In FIG. 1, the valve member is shown at its top dead center (TDC in FIG. 7) in which, pressed against the seat 6, it closes off the admission port 3.

In this position, the sum $P+P_1$ of the pressure prevailing inside the cylinder 11 and of the rated pressure of the check valve 14 is less than or equal to the feed pressure $P_A$, which causes the check valve 14 to open until the pressures become balanced, which occurs when $P=P_m$.

Figure 7:
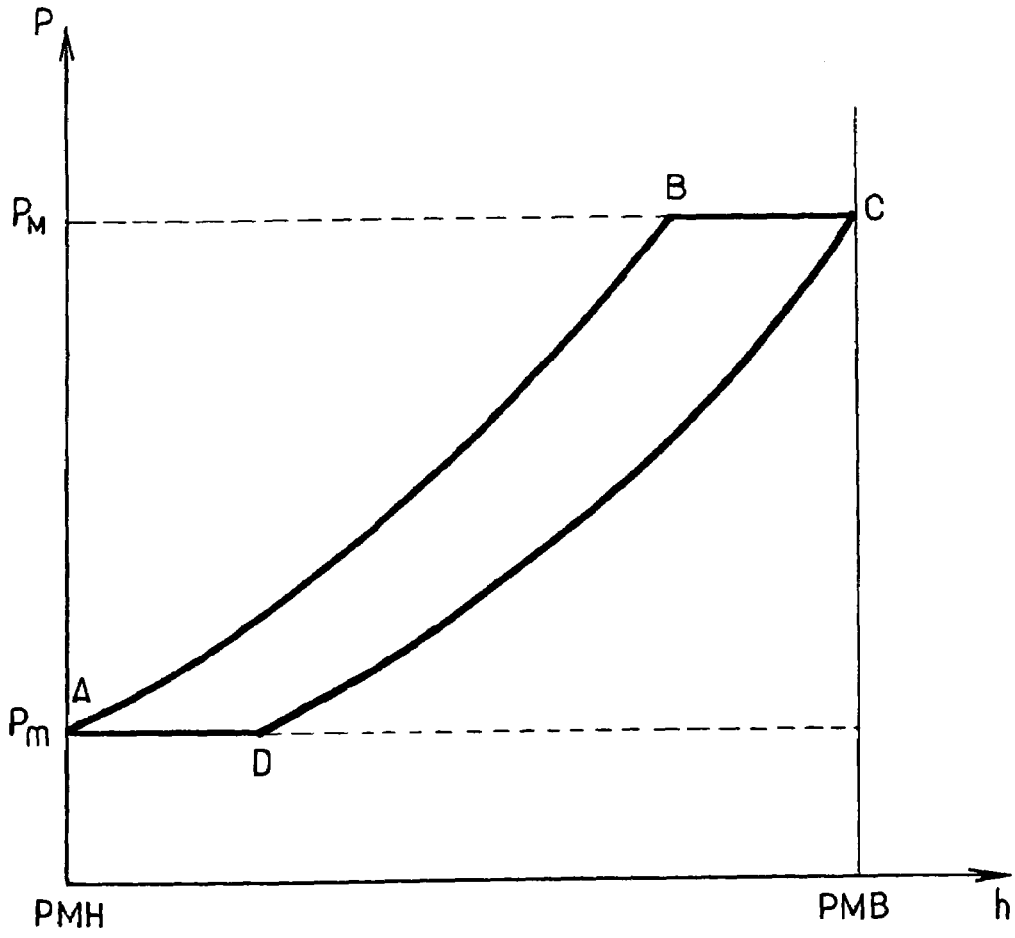
FIG. 7 is an indicator diagram showing the variations in the pressure P inside the cylinder, as a function of the displacement h of the piston, during a full opening/closure cycle of the valve.

When the pressures become balanced, the check valve 14 closes again (FIG. 2), which corresponds to point A on the graph in FIG. 7.

The cam 9 turning (FIG. 3) then causes the valve 2 to move towards its open position, thereby compressing the fluid contained in the cylinder 11.

The pressure P increases until its value reaches the maximum pressure $P_M$, which corresponds to point B on the graph in FIG. 7.

At this instant, the pressures become balanced in the pressure relief valve 15: the piston 19 is pushed towards its open position, the discharge channel 16 thus being put into communication with the expansion chamber 22. The pressure P is thus maintained equal to the maximum pressure $P_M$.

Figure 4:
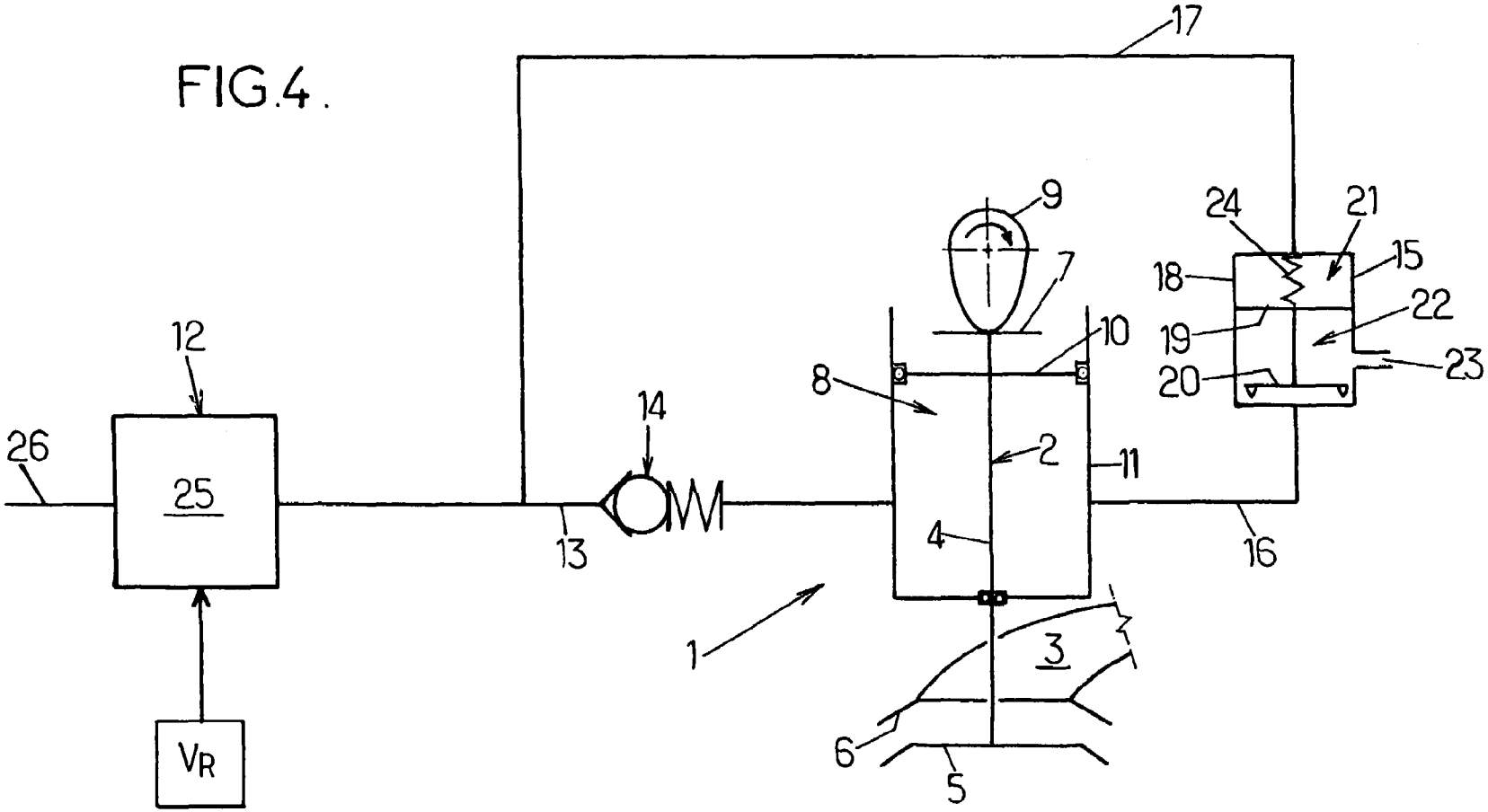
Figure 5:
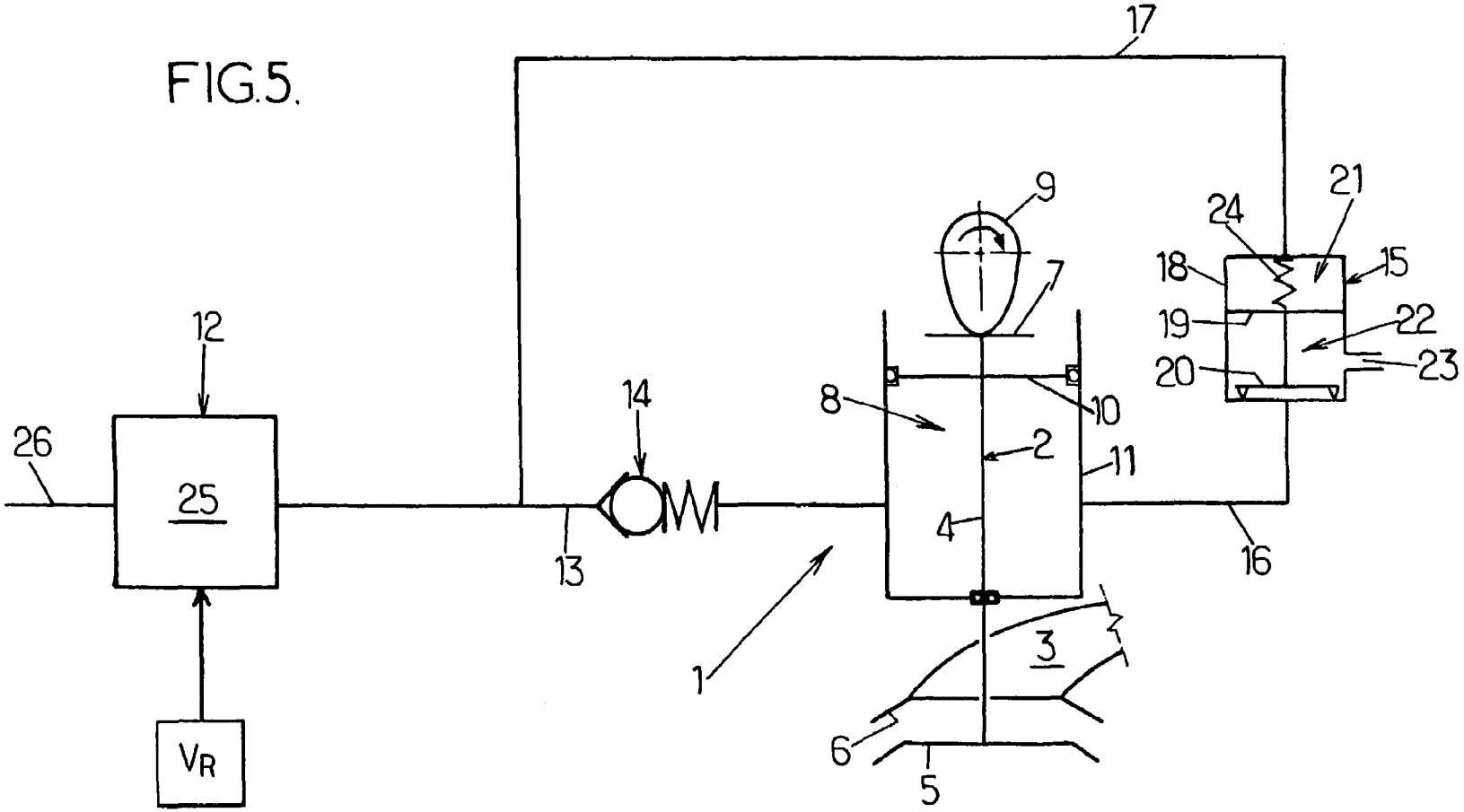

This situation, which corresponds to the line between points B and C on the graph in FIG. 7, lasts so long as the movement of the cam 9 tends to compress the fluid that is contained in the cylinder 11 (FIG. 4).

When the valve 2 reaches its bottom dead center (BDC), the fluid present in the cylinder 11 no longer tends to be compressed, so that the pressure $P_M$ prevailing in the excess pressure chamber 21 is sufficient to push the piston 19 back towards its closed position, the valve member 20 thus closing off the discharge channel 16 again (FIG. 5), which corresponds to point C on the graph in FIG. 7.

Figure 6:
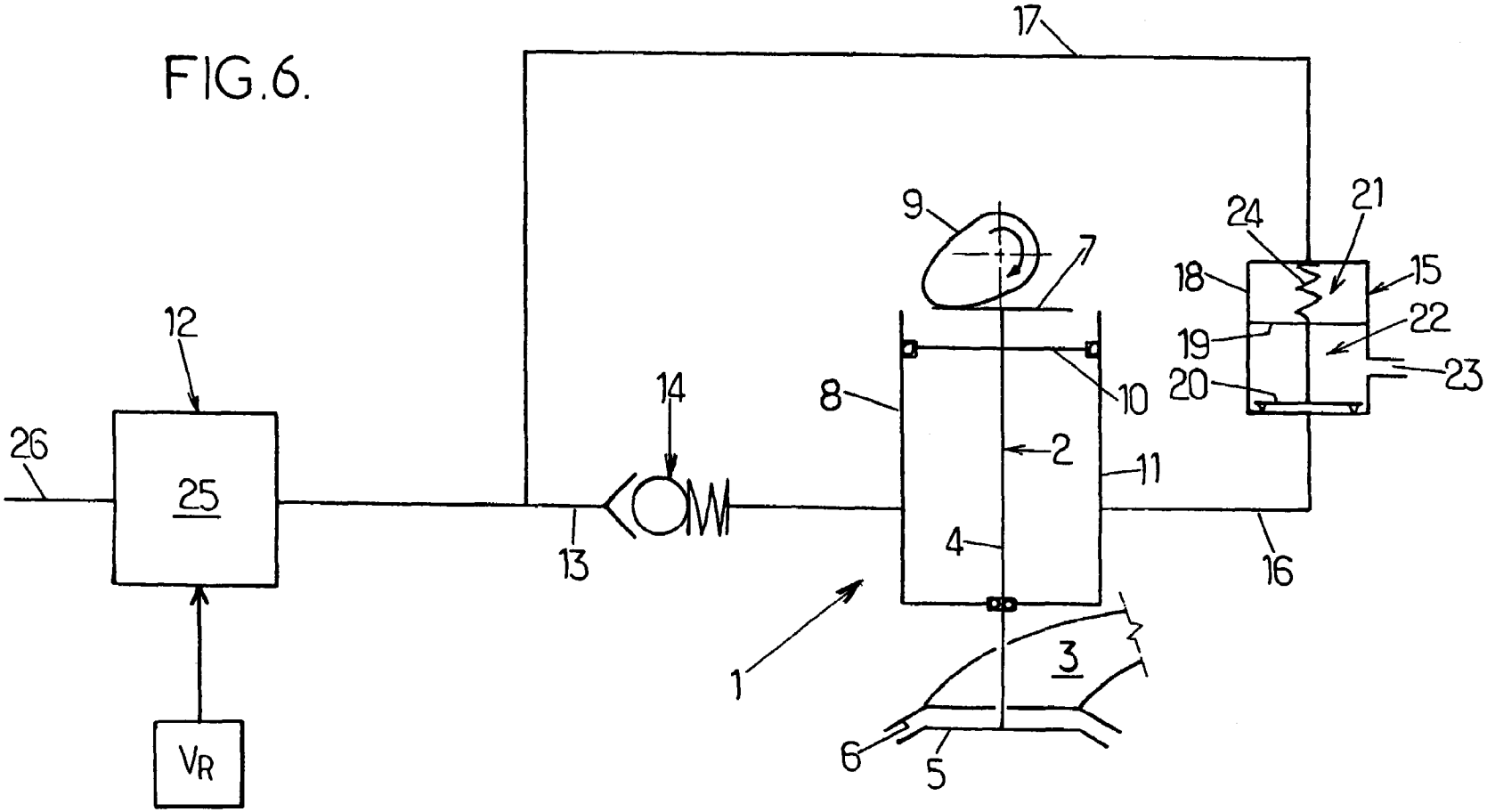

The cam 9 turning then enables the valve 2 to rise towards its closed position, as shown in FIG. 6, under drive from the pneumatic return spring 8 constituted by the fluid under pressure that is present in the cylinder 11, and that holds the cam follower 7 in continuous contact with the cam 9. The fluid present in the cylinder 11 then expands, which corresponds to the line between points C and D on the graph in FIG. 7.

This expansion continues until the pressure P of the fluid present in the cylinder 11 reaches its minimum value $P_m$ (point D on the graph in FIG. 7), which causes the check valve 14 to open (FIG. 6).

This situation (corresponding to the line between the points D and A on the graph in FIG. 7) lasts so long as the valve 2 has not reached its top dead center again, the pressure P of the fluid present in the cylinder 11 thus being maintained constant and equal to the minimum value $P_m$ in spite of the movement of the valve 2 which, following the cam 9, tends to expand the fluid.

Once the valve 2 reaches its top dead center (FIG. 1), the cycle described above starts again.

It can be understood that the presence of the check valve 14 and of the pressure relief valve 15 enables the return force exerted on the valve 2 by the pneumatic spring 8 constituted by the fluid present in the cylinder 11 to be limited to within the range defined by two extreme values (corresponding respectively to the minimum pressure $P_m$ and to the maximum pressure $P_M$).

In order to optimize the movement of the valve (and in particular in order to prevent it from hunting), it is desired to cause the rate of the pneumatic spring 9 to vary as a function of one or more determined parameters.

In practice, it is desired to cause said rate to vary as a function of engine speed, and, more precisely, it is desired to increase the rate of the pneumatic spring 8 when the speed of revolution $V_R$ of the drive shaft increases, thereby making it possible to increase the reactivity of the valve and to increase the limit at which it thrashes.

Figure 8:
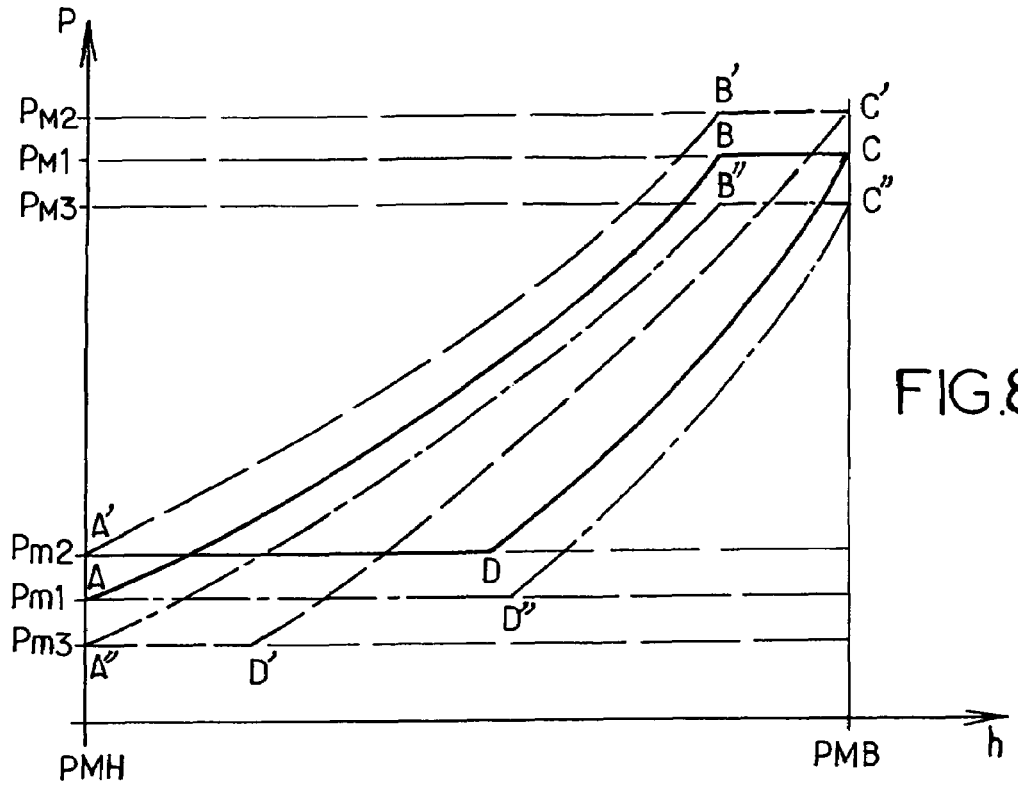
FIGS. 8 and 9 are indicator diagrams analogous to the diagram of FIG. 7, showing opening/closure cycles of the valve, with the feed pressure being regulated.

FIG. 8 is a graph showing the pressure P of the fluid contained in the cylinder 11 as a function of the displacement h of the piston 10, showing three successive opening/closure cycles of the valve 2, between which firstly the feed pressure $P_A$ is caused to increase consecutively to an increase in the engine speed, and then the feed pressure $P_A$ is caused to decrease consecutively to a decrease in the engine speed.

To begin with (point A), the pressure P is equal to the minimum pressure $P_{m1}$ corresponding to the initial feed pressure $P_A$. This initial feed pressure $P_A$ also corresponds to a maximum pressure $P_{M1}$ that prevails in the excess pressure chamber 21.

The opening stage of the valve 2 is as described above (between points A and B, uninterrupted curve), the pressure relief valve 15 acting (between points B and C) when the pressure P reaches the maximum pressure $P_{M1}$.

The engine speed is increased (arbitrarily) during the closure stage of the valve 2, corresponding to the fluid expanding (between points C and D on the graph in FIG. 8): the regulator 25 then causes the feed pressure $P_A$ to increase.

As a result, the minimum pressure increases to become established at a new value $P_{m2}$ while the maximum pressure simultaneously becomes established, via the branch channel 17, at a new value referenced $P_{M2}$, these new values $P_{m2}$ and $P_{M2}$ being respectively greater than the preceding values $P_{m1}$ and $P_{M1}$.

When the pressure P reaches the minimum pressure $P_{m2}$, the check valve 14 comes into action, the pressure P then remaining constant and equal to the value $P_{m2}$ until the valve reaches its top dead center again (point A' on the graph in FIG. 8).

The pneumatic spring 8 is thus modified relative to the preceding cycle, with its rate being greater.

The opening stage of the valve is as described above (points B' and C', dashed-line curve). During the closure stage of the valve 2 (between points C' and D'), the engine speed is decreased (arbitrarily): the regulator 25 then causes the feed pressure $P_A$ to decrease, the minimum pressure then becoming established at a new value $P_{m3}$ while the maximum pressure that prevails in the excess-pressure chamber 21 becomes established at a new value $P_{M3}$, the new values $P_{m3}$ and $P_{M3}$ being respectively less than the initial values $P_{m1}$ and $P_{M1}$.

When, during the expansion, the pressure P reaches the value $P_{m3}$ (point D'), the pressure relief valve 15 comes into action to maintain the pressure P constant at this value (between the points D' and A") so long as the valve 2 has not reached its top dead center (point A").

The opening stage of the valve 2 is then repeated as above (between points A" and B", then between points B" and C", dot-dash curve), the pneumatic spring 8 presenting, however, rate that is less than the rate that it presented during the preceding cycles;

During the expansion (between points C" and D"), it is assumed that the engine speed is caused to increase again to its initial value.

The regulator 25 then causes the feed pressure $P_A$ to increase, the minimum and the maximum pressures then finding themselves in their respective initial values $P_{m1}$ and $P_{M1}$.

When the pressure P reaches the minimum value $P_{m1}$ (point D"), the valve 14 then comes into action to maintain the pressure P constant at said value (between points D" and A).

Figure 9:
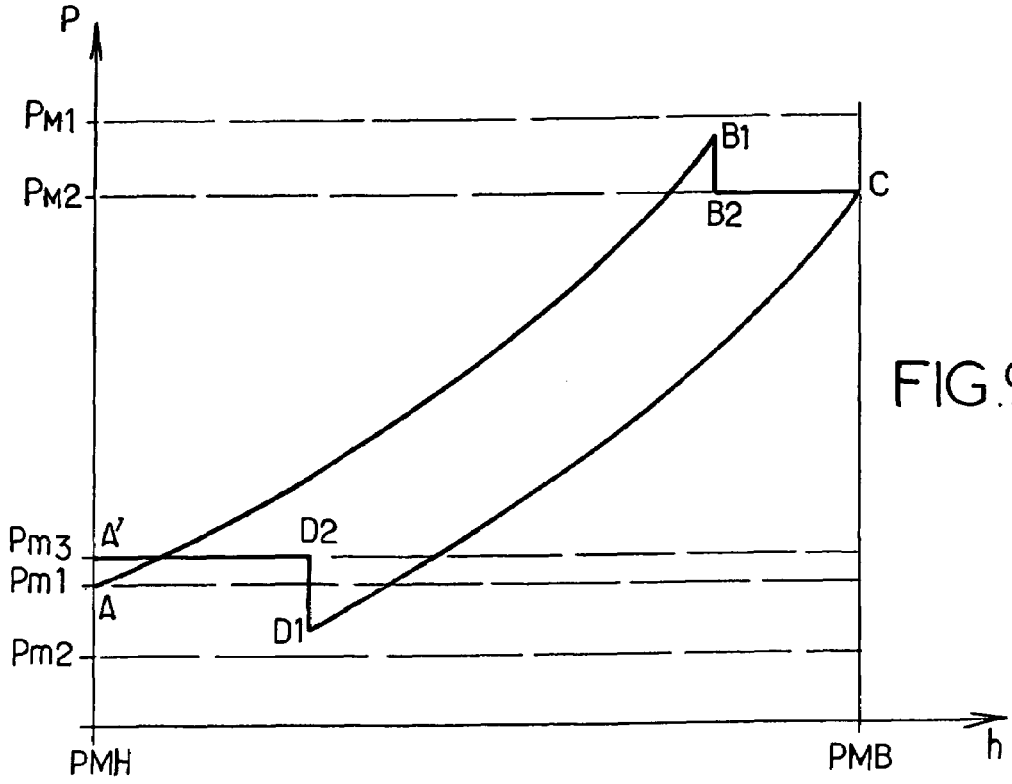

FIG. 9 shows an opening/closure stage of the valve 2, during which the following take place in succession:

during the opening stage, a decrease in the engine speed before the pressure P has reached the initial maximum pressure $P_{M1}$ but after it has increased to above the new value $P_{M2}$ resulting from the regulation of the feed pressure $P_A$; and during the expansion, a sudden increase in the engine speed before the pressure P has reached the minimum value $P_{m2}$ corresponding to said regulation, but after the pressure P has decreased to below the value $P_{m3}$ resulting from the new regulation of the feed pressure $P_A$.

To begin with (point A), the minimum pressure is at a value $P_{m1}$, the valve 2 being at its top dead center.

As described above, the cam 9 turning causes the fluid present in the cylinder 11 to be compressed. However, at a given time (point $B_1$ on the graph in FIG. 9) at which the pressure P has not yet reached the maximum value $P_{M1}$, a sudden decrease in the engine speed occurs, resulting in the regulator 25 causing the feed pressure $P_A$ to be reduced, the minimum and maximum pressures then becoming established at values $P_{m2}$ and $P_{M2}$ respectively less than the initial values $P_{m1}$ and $P_{m1}$.

The excess pressure immediately causes the valve 15 to open, the pressure P falling to reach the new value for the maximum pressure $P_{M2}$ (point $B_2$).

It should be noted that, on the graph in FIG. 9, account is not taken of the inertia of the system, so that the segment interconnecting the points $B_1$ and $B_2$ appears both rectilinear and vertical.

The cycle continues (momentarily) as described above. The pressure P is maintained constant and equal to the value $P_{M2}$ until the bottom dead center (point C) is reached, whereupon the pressure relief valve 15 is closed, the cycle then starting its opening stage for opening the valve 2.

During the expansion, and before the pressure P has reached the current minimum value $P_{m2}$ (point $D_1$), a sudden increase in the engine speed occurs that the regulator 25 passes on via an increase in the feed pressure, the minimum pressure then being established at a new value $P_{m3}$ that is greater in the example described than the preceding values $P_{m1}$ and $P_{m2}$.

The check valve 14 then comes into action, the pressure P then rising suddenly to the new minimum value $P_{m3}$ (point $D_2$), which value it maintains until the top dead center (point A') is reached.

As above, the inertia of the system is ignored, so that the segment on the graph of FIG. 9 that interconnects the points $D_1$ and $D_2$ appears both rectilinear and vertical.

As described above, the return device 1 makes it possible to regulate not only the minimum pressure $P_m$ required in the cylinder 11, but also the maximum pressure $P_M$, as a function of the feed pressure $P_A$.

This regulation satisfies an affine-type relationship, which makes it possible to regulate precisely the rate of the pneumatic spring 8 as a function, in particular as presented above, of engine speed.

As explained above, this regulation is effected simply and rapidly because the pressure relief valve 15 is connected directly to the feed 12.

The above-described structure (in particular the presence of the branch channel 17 and of the return spring 24) makes it possible to establish simply the affine-pressure relationship $P_M=\lambda P_A+P_2$ that governs the maximum pressure $P_M$.

Simultaneously, the minimum pressure $P_m$ is also governed by an affine-type relationship because it satisfies the relationship $P_m=P_A-P_1$, which results from the presence of the check valve 14 on the feed channel 13.

It is thus possible to cause the rate of the pneumatic spring 8 to vary linearly as a function (as explained above) of engine speed, so that said rate is both sufficiently high (resulting from regulating the minimum pressure $P_m$) to avoid valve hunting, and also sufficiently moderate to avoid premature wear of the parts in contact, namely the valve tail 7 and the corresponding cam 9.

What is claimed is:

1. A return device for returning a valve of an internal combustion engine, the device comprising:

a piston secured to said valve and mounted to slide in a cylinder;

a pressurized fluid feed at a feed pressure connected to said cylinder via a feed channel; and a pressure relief valve connected to said cylinder via a discharge channel and arranged to limit the pressure prevailing in the cylinder to a predetermined maximum pressure;

said device further comprising means for regulating the predetermined maximum pressure as a function of the feed pressure using an affine-type relationship.

2. A device according to claim 1, in which the predetermined maximum pressure is a function of the feed pressure using a relationship of the following type:

$$P_M=\lambda P_A+P_2$$

where:

$P_M$ is the predetermined maximum pressure;

$\lambda$ is a constant;

$P_A$ is the feed pressure; and $P_2$ is a constant.

3. A device according to claim 2, in which, with the pressure relief valve being provided with a return spring, the constant $P_2$ is the rated pressure of said pressure relief valve, delivered by said return spring.

4. A device according to claim 1, in which the pressure relief valve is connected to the pressurized fluid feed via a branch channel.

5. A device according to claim 1, further comprising a check valve placed on the feed channel.

6. A device according to claim 4, further comprising a check valve placed on the feed channel, and in which the branch channel is connected to the feed upstream from the check valve.

7. A device according to claim 1, in which the feed is controlled so as to regulate the feed pressure as a function of one or more determined parameters.

8. A device according to claim 7, in which the feed is controlled so as to regulate the feed pressure as a function of engine speed.

9. A device according to claim 8, in which the feed is controlled so as to increase the feed pressure when the engine speed increases.

10. An internal combustion engine equipped with a return device according to claim 1.

* * * * *